US006843191B1

(12) United States Patent
Makotinsky

(10) Patent No.: US 6,843,191 B1
(45) Date of Patent: Jan. 18, 2005

(54) DEVICE AND METHOD FOR RAISING SUNKEN OBJECTS

(76) Inventor: Valentin Makotinsky, 1781 Riverside Dr., New York, NY (US) 10034

( * ) Notice: Subject to any disclaimer, the term of this patent is extended or adjusted under 35 U.S.C. 154(b) by 0 days.

(21) Appl. No.: 10/847,763

(22) Filed: May 19, 2004

(51) Int. Cl.[7] ..... B63C 7/14
(52) U.S. Cl. ..... 114/51; 114/50; 405/3
(58) Field of Search ..... 405/3, 61; 114/50, 114/51

(56) References Cited

U.S. PATENT DOCUMENTS

| | | | | | |
|---|---|---|---|---|---|
| 1,495,310 A | * | 5/1924 | Stromborg | ..... | 405/61 |
| 4,690,087 A | | 9/1987 | Hadjis | | |
| 5,666,898 A | * | 9/1997 | Bell | ..... | 114/51 |
| 6,698,376 B2 | * | 3/2004 | Delahousse et al. | ..... | 114/51 |

FOREIGN PATENT DOCUMENTS

| | | | | | |
|---|---|---|---|---|---|
| GB | 2068299 | * | 8/1981 | ..... | 114/50 |
| RU | 2009954 | | 3/1994 | | |
| RU | 2192985 | | 11/2002 | | |
| SU | 1188045 | | 10/1985 | | |
| SU | 1785948 | | 1/1993 | | |

* cited by examiner

*Primary Examiner*—Frederick L. Lagman
(74) *Attorney, Agent, or Firm*—Boris Leschinsky

(57) ABSTRACT

A device and method for raising sunken objects such as crates, small boats, vessels and ships including a platform equipped with winches to lower down a basket net and a frame supporting a cryogenic apparatus to the vicinity of the object. The cryogenic apparatus is adapted to pump surrounding water through a freezing unit to reduce its temperature to below freezing and then form a stream of overcooled water directed over the sunken object to form a layer of ice about it. The basket net contains provisions to allow its closure under the object once it is lifted off the sea floor. Once enough ice is formed, the object is lifted to the surface. On average, the capacity of the cryogenic apparatus is such that a 1 ton object can be lifted in about 3 hours. Remote monitoring and control means are provided for the operator to observe and direct the operation of the device. The device is especially advantageous in dealing with explosive objects such as old and unwanted sea mines, torpedoes and alike.

15 Claims, 4 Drawing Sheets

DEVICE AND METHOD FOR RAISING SUNKEN OBJECTS

BACKGROUND OF THE INVENTION

The present invention relates generally to a device and a method for raising sunken objects including small ships and vessels. More particularly, the present invention describes the use of overcooled water to form a layer of ice about the sunken object to temporarily increase its buoyancy.

The problem of recovering sunken objects has been around for hundreds of years. In a typical situation, the sunken object such as a small vessel is pulled up by hoisting cables wrapped about the object. This method has a major disadvantage in that the cables or ropes have to be wrapped first about the object and then the object can be pulled to the surface. At depths greater than divable depths, this procedure can not be easily accomplished since divers are generally needed to position and secure the cables around the object.

Attempts have been made to fill the hull of the vessel with particulate lighter than water and therefore increase the buoyancy of the object so it can be lifted easier. This method is also difficult to achieve as the hull is not always intact and may have openings at different locations making it impossible to contain the filling particulate inside.

Another method known in the prior art is to submerge a hollow chamber next to the object and then attach it to the object. Air is then pumped into the chamber to allow for its lifting together with the object. This method is rather complex and requires a large hollow chamber to be available so a designating recovery ship is usually needed for this operation.

The use of ice is also known in the art of recovery of sunken objects. The advantage is that ice weighs less than water and by attaching a large amount of ice to the sunken object, its buoyancy can be increased. Ice may be formed onsite and therefore easily available. Once on the surface, the ice is simply discarded back into the water.

Several patents of the prior art describe various methods of using ice to recover sunken objects. U.S. Pat. No. 4,690,087 as well as Russian Patents SU 1,785,948; RU 2,009,954; and RU 2,192,985 incorporated herein in their entirety by reference, all describe devices supplying liquid nitrogen or another cryogenic liquid through a network of channels placed about the sunken object to attach that network to the object and form ice about thereof. These methods and devices have limited efficacy since the ice can be formed only up to certain depth about such pipes due to the fact that further increase in depth is limited by the previous layer of ice already formed around each pipe. Therefore, the devices become more complex as more and more pipes are needed both inside and outside the vessel hull. In addition, assembling and subsequent dismantling of the pipe network around the vessel is complicated and requires significant efforts.

The need therefore exists for a simple cryogenic device and method for raising sunken objects without the need for complicated pipe network to be constructed around the object and providing an ability to attach ice of substantial thickness to the sunken object so that it can be easily lifted to the surface.

SUMMARY OF THE INVENTION

Accordingly, it is an object of the present invention to overcome these and other drawbacks of the prior art by providing a novel device and method for raising sunken objects in which the overcooled water is supplied from a cryogenic apparatus to form ice about the sunken object.

It is another object of the present invention to provide a device and method for raising sunken objects by increasing the buoyancy of the object as a result of attaching a layer of ice about the exterior and interior of the object.

It is a further object of the present invention to provide a device for raising sunken objects which is simple to operate and small in size so as it can be transported to the site by a regular ship.

It is a further yet objective of the present invention to provide a device and method to cover the sunken object with ice of desirable thickness and at desirable locations.

It is yet a further object of the present invention to provide a device for raising the sunken objects equipped with a rope and cable basket adapted to envelope the object without tangling on itself.

The device and method of the invention are based on providing a high flow velocity cryogenic apparatus capable of forming an underwater stream of overcooled water and directing it over the desired locations of the sunken objects. The water is cooled to the temperature below freezing but is still flowable while inside the device because of its high velocity. Once the stream of such water reaches the sunken object, freezing of the water causes ice forming on the surface thereof.

The device of the invention is therefore rather small and portable and so it can be easily transported to a site where the sunken object is located by a regular ship or boat. Its operation is also not complicated since no great precision is needed to direct the stream towards the sunken object. Another important advantage is that the thickness of the ice layer is determined by the duration of supplying the stream of overcooled water to a particular location and can theoretically be unlimited and not dependent on the piping network as in the prior art devices. This allows easy balancing of the patches of ice all the way around the object if it is large so a uniform lifting force can be created and the object can be lifted straight up.

A variety of objects can be raised from the sea floor including small objects like crates, barrels, antique canons and such as well as small and medium size entire boats, ships and vessels.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENT OF THE INVENTION

A detailed description of the present invention follows with reference to accompanying drawings in which like elements are indicated by like reference letters and numerals.

Figure 1:
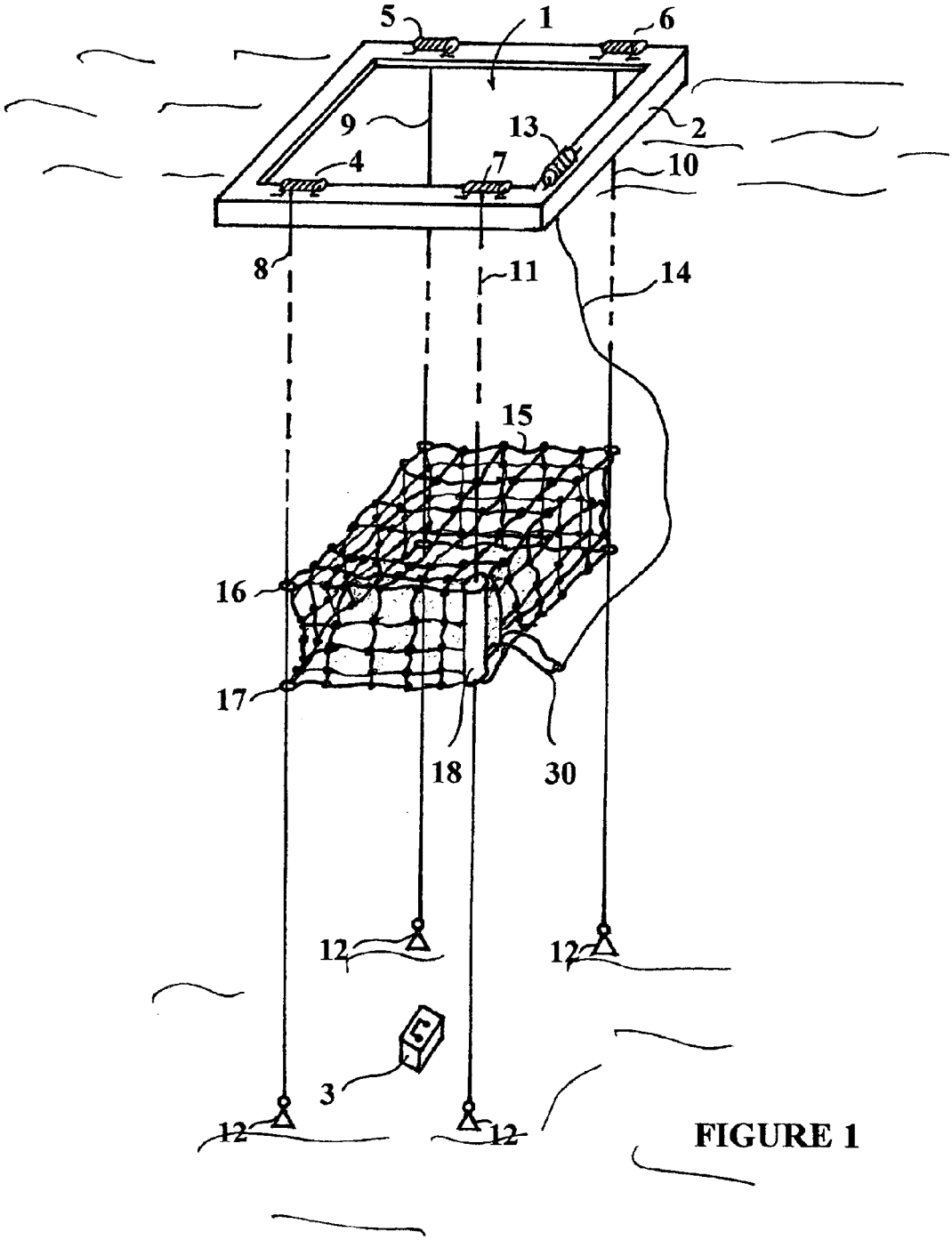
FIG. 1 is side view of a raising platform with the cables and basket net.

At the heart of the present invention is the raising platform 1 shown on FIG. 1. It comprises a four-sided frame 2, which can in turn be attached to or suspended from a salvage ship as well as be hollow so as to float on water itself and be capable of supporting the sunken object at the end of the salvage procedure.

On the top of the raising platform there are attached two pairs of winches 4, 5, 6, and 7, each having a corresponding cable 8, 9, 10, and 11 equipped with an anchor or a weight 12 at the end thereof. The side of the raising platform 1 that is free of the above-mentioned winches 4, 5, 6, or 7 contains a raising winch 13 with a raising cable 14. A rectangular or square basket shaped inverted net 15 with an open bottom is adapted to be moved up and down the cables 8, 9, 10, and 11 by having rings 16 on the corners of its inverted bottom sliding along cables 8 through 11. The basket net 15 may be made out of ropes, cables and alike as long as it is made strong enough to support the sunken object. The lower portion of the basket net 15 is equipped with three break-away rings 17 at its three corners sliding along the cables 8, 9, and 10. The fourth corner has a control unit 18 attaching thereof to the cable 11. Air-filled chambers may be optionally attached to the basket net 15 (not shown on the drawing) so as to better control its shape during the various maneuvers of the salvaging operation as well as to further increase the buoyancy of the sunken object. The lower part of the basket net 15 also contains a plurality of rings 19.

While rings 16 and 19 are made from a durable material such as metal, rings 17 are made from a material which easily breaks under load such as plastic because of the reasons explained in more detail below.

Figure 4:
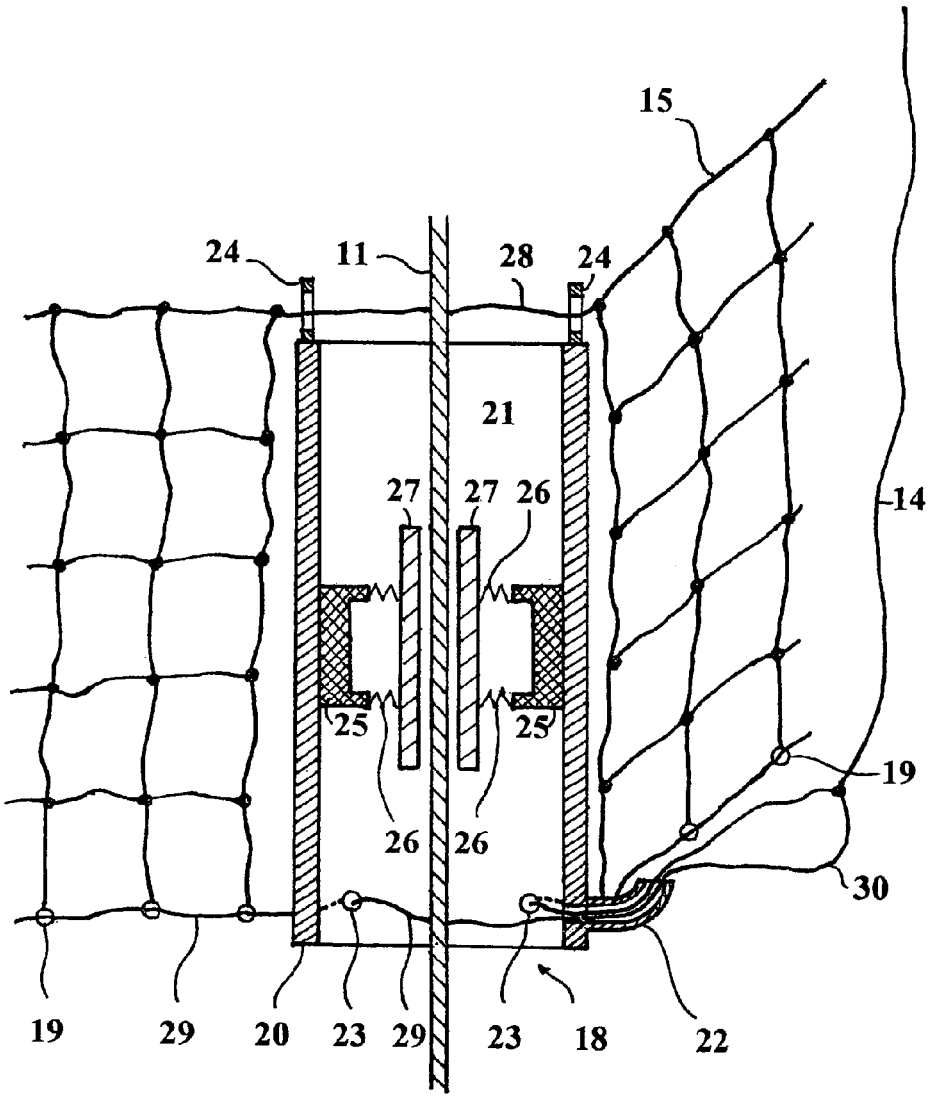
FIG. 4 is a side view in cross-section of control unit of the cable and basket net.

The control unit 18 comprises a cylindrical housing 20 containing a braking unit 21 (see FIG. 4). At the bottom of the control unit 18 there is provided a connector tube 22 two openings 23. Importantly, the size of the openings 23 is smaller than the breakaway rings 17. The breaking unit 21 contains two electromagnets 25, connected through the springs 26 with the braking pads 27, adapted to surround but normally not touch the cable 11. In an alternate configuration, the pads 27 are normally locked about the cable 11 by the action of the springs 26. Electromagnets in that case are adapted to pull the pads aside when activated to release the cable 11.

Cable 28 is pulled through the rings 24 on top of the control unit 18. Cable 29 is pulled through the rings 19 located on the bottom of the basket net 15 and the openings 23 inside the housing 20. The ends of the cable 29 are pulled through the connector tube 22 outside the housing 20 and are connected together forming therefore the loop 30. The loop 30 in turn is connected to the cable 14 and the raising winch 13. Importantly, the cable 29 is made to be heavier (from metal for example) than the cable 28 so as not to tangle with it during the manipulations of the device. This provides for easy lowering of the entire basket net 15 during the first stages of the raising operation.

Figure 2:
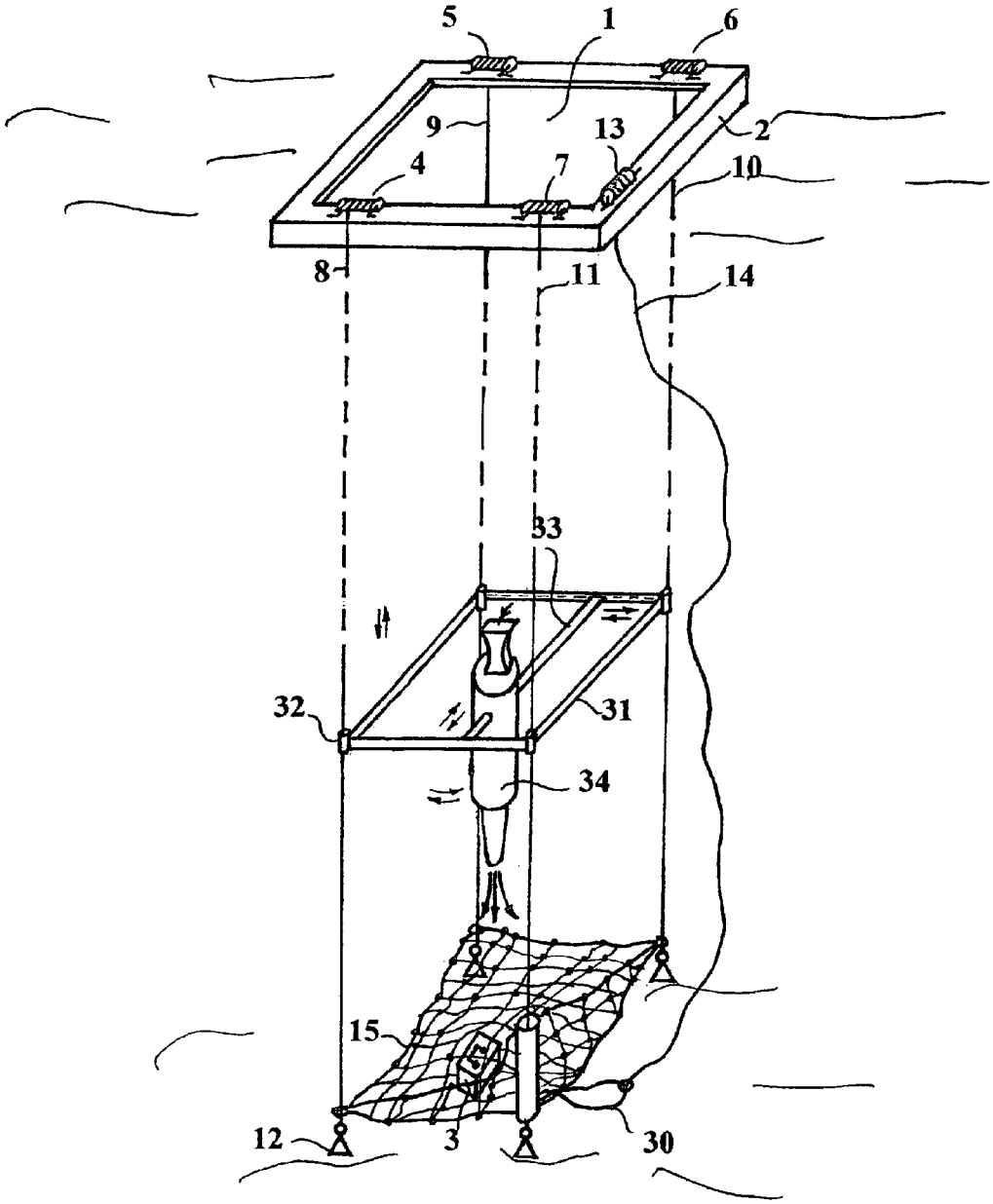
FIG. 2 is a side view of the raising platform of the device, a cryogenic overcooled water supply apparatus and a cable and basket net wrapped about the sunken object at the beginning of the process of raising the object.
Figure 3:
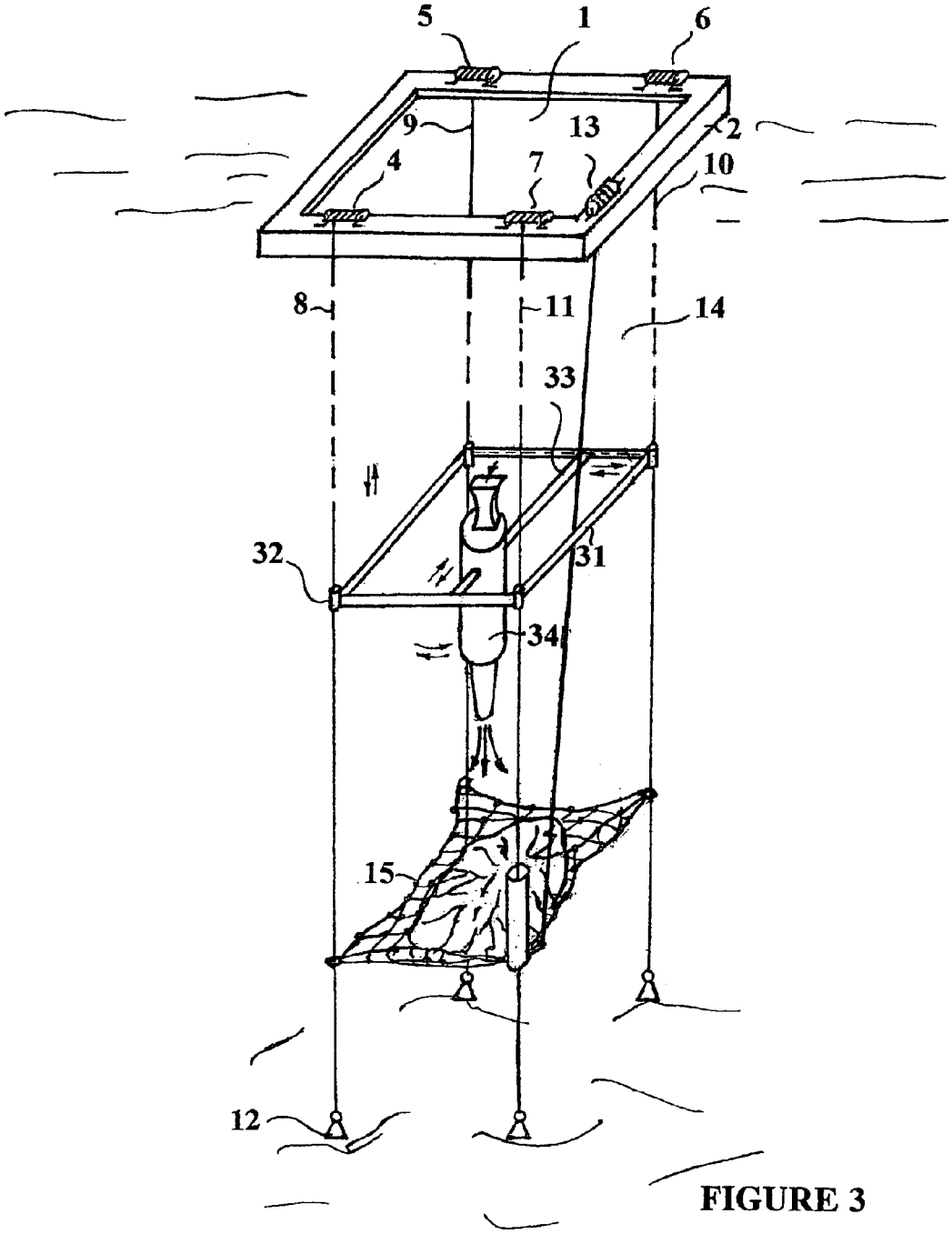
FIG. 3 is a side view of all the above elements of the device after the cable is pulled, the sunken object and the basket net enveloping thereof are both covered with a layer of ice and ready for lifting to the surface.

FIGS. 2 and 3 further illustrate the additional frame 31 suspended from the raising platform 1 on the cables 8, 9, 10, and 11. It can be raised and lowered with an additional winch and cable (not shown on the drawings). The corners of the frame 31 are equipped with hollow cylinders 32 having stops (not shown) adapted to bring the frame 31 to a predetermined depth along the cables 8 through 11. Optionally, the frame 31 also contains remotely controlled visual identification means such as lights and TV cameras to provide information back to the control room about the situation under water. Alternately, radar means, ultrasound means, or any other commonly used visualization means may be deployed to provide the same information to the operators of the device of the present invention.

Horizontal rail 33 is mounted inside the frame 31 and supports the cryogenic apparatus 34 mounted thereon with the means of moving and tilting thereof forward and back on the rail 33. The cryogenic apparatus 34 in turn comprises a water pump pumping water through a labyrinth of a freezing chamber containing liquid nitrogen or another freezing agent. Importantly, the cryogenic apparatus 34 forms a high velocity stream of overcooled water at a temperature below normal freezing temperature of water so as it reaches the sunken object it slows down and freezes all around thereof. Remotely controlled technical means are envisioned allowing moving the cryogenic apparatus 34 back and forth along the rail 33 as well as tilting it from side to side inside the frame 31. One or more electrical motors may be used for this purpose for activating a system of pulleys, gears, levers, mechanical joints, or another commonly known mechanisms. The operator from the salvage ship remotely controls the movements of the apparatus 34.

In operation, the process of raising the sunken object 3 is started by the operator of the device turning on the winches 4, 5, 6, and 7 to release the cables 8 through 11 until the anchors 12 reach the sea floor (see FIG. 2). The rings 16 and 17 as well as the control unit 18 are then all freely lowered down along the cables 8 through 11 so as to lower the basket net 15 over and about the sunken object 3. The operator then brings down the frame 31 on the same cables 8 through 11 and stops it so that the cryogenic apparatus 34 is located in the near vicinity of the object 3 as indicated by the visual control means located on the frame 31.

The operator then activates the cryogenic apparatus 34 to direct the overcooled water stream towards the object 3 and the basket net 15 surrounding it to form a controlled layer of ice thereon. The operator can control the direction of the water stream by remotely moving the nozzle of the cryogenic apparatus 34 back and fourth and from side to side so as to deliberately form desired thickness of ice at various points along the object 3. As the ice layer forms around the object 3, the top portion of the basket net is encased within the layer of ice and therefore is attached to the object 3. That process is continuing until the amount of ice is enough to lift the object 3 and the basket net 15 off the sea floor.

As the object 3 starts to slowly move upwards, the operator activates the breaking unit 21 of the control unit 18. Energizing and de-energizing electromagnets 25 counteracts the action of the springs 26 allowing the operator to cause the braking pads 27 to either firmly grab or release the cable 11. That action in turn allows the operator to control lifting the position of object 3 close to the bottom and avoid uncontrolled upward movement to the surface. The operator then turns on the raising winch 13 applying tension on the cable 14 and therefore on the loop 30. The loop 30 is then pulled away along with the cable 29 from the connecting tube 22 and away from the control unit 18. The cable 29 then brakes the rings 17 and closes the lower portion of the basket net 15 about the bottom of the object 3 as the loop 30 is pulled further and further away from the control unit 18.

Once the object 3 is surrounded from all sides by the basket net 15, the operator can again turn on the cryogenic apparatus 34 to increase further the thickness of ice around the object so it brings itself to the surface. Alternatively or in addition to it, the operator can raise the object as is by activating the winches 4 through 7 of the raising platform 1. Of course, the frame 31 is lifted along with the object 3 as well so as to keep the nozzle of the cryogenic apparatus 34 in operable vicinity of the object 3. The force needed to lift the frame 31 comes from either the reactive force associated with the operation of the cryogenic apparatus 34 or from a dedicated winch or alike (not shown).

The speed of raising the object may be conveniently adjusted by turning on and off the action of cryogenic apparatus 34 so as to increase or decrease the amount of ice around the object 3. Another way to adjust that speed is to turn on and off the braking unit 21 of the control unit 18.

The device of the invention can be used advantageously when lifting explosive, radioactive, or other dangerous objects from the sea floor. Calculations show that it takes about 3 hours to raise an object having a weight of about 1 metric ton. This is a rather fast process, which further decreases the risk of an accident associated with salvage and recovery of such dangerous objects as military mines, torpedoes, and alike. Besides, the presence of a thick layer of ice and remote control of the entire operation increases the safety even further as well as removes environmental risks as it reduces the risk of spontaneous explosion of such an object.

Although the invention herein has been described with respect to particular embodiments, it is understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A device for raising a sunken object comprising:

a platform containing a cable means and a lifting and lowering means for said cable means, a basket net adapted to slide along said cable means and to cover said sunken object, a frame means adapted to slide along said cable means above said basket net, a cryogenic means supported on said frame means above said basket means and above said sunken object in the vicinity thereof, said cryogenic means further comprising a water pump adapted to pump said water through a freezing means to bring its temperature to below its freezing temperature, said pump further adapted to form a stream of water over said sunken object, and a control system for remotely monitoring and controlling the operation of said lifting and lowering means and said cryogenic means.

2. The device as in claim 1, wherein said lifting and lowering means are winches.

3. The device as in claim 1, wherein said cable means comprising four cables equipped with anchors at their ends.

4. The device as in claim 1, wherein said basket net having an upper portion and a lower portion of a rectangular shape defining four upper and four lower corners, each upper corner containing a first ring sized to slide freely over said cable means.

5. The device as in claim 4, wherein said basket net further comprising three breakaway rings at the three lower corners and a control unit at the fourth lower corner thereof, said control unit adapted to bring all four lower corners together while under said sunken object to entirely enclose thereof.

6. The device as in claim 5, wherein said control unit including braking means to control the movement of said control unit along said cable means.

7. The device as in claim 6, wherein said breaking means further including at least one electromagnet and braking pads surrounding said cable means.

8. The device as in claim 1, wherein said frame means including a horizontal rail and a remotely controlled technical means supporting said cryogenic means on said horizontal rail, said technical means adapted to moving said cryogenic means along said rail and tilting it from side to side.

9. The device as in claim 1, wherein said frame means further including remotely controlled visual identification means.

10. The device as in claim 9, wherein said remotely controlled visual identification means including lighting means and video recording means.

11. A method for raising a sunken object comprising the steps of:

a. deploying a basket net over said object, b. providing a cryogenic means and positioning said means above said basket means and above said sunken object in the vicinity thereof, c. activating said cryogenic means to pump a stream of overcooled water over said sunken object, said overcooled water being at a temperature below its freezing temperature after leaving said cryogenic means, d. forming a layer of ice about said object and said basket net to raise its buoyancy by freezing said overcooled water, and e. bringing up the sunken object once enough ice is formed thereabout.

12. The method as in claim 11, wherein said step "e" further comprising a step of enclosing said sunken object in said basket net once it is lifted.

13. The method as in claim 11, wherein said step "c" further comprising a step or remotely monitoring and controlling the position of said cryogenic means over said sunken object to form ice at predetermined locations thereof and of predetermined thickness.

14. The method as in claim 11, wherein said step "d" further comprising a step of attaching said basket net to said sunken object by forming ice therethrough.

15. The method as in claim 11, wherein said step "e" further comprising a step of adjusting the speed of raising said sunken object by turning on and off said cryogenic means to selectively increase or decrease the amount of ice about said object.

* * * * *